US005705100A

United States Patent [19]

Nagata et al.

[11] Patent Number: 5,705,100

[45] Date of Patent: Jan. 6, 1998

[54] RESISTIVE MATERIAL, AND RESISTIVE PASTE AND RESISTOR COMPRISING THE MATERIAL

[75] Inventors: Keisuke Nagata, Kyoto; Hiroji Tani, Nagaokakyo, both of Japan

[73] Assignee: Murata Manufacturing Co., Ltd., Kyoto-fu, Japan

[21] Appl. No.: 578,103

[22] Filed: Dec. 26, 1995

[30] Foreign Application Priority Data

Dec. 30, 1994 [JP] Japan ..... 6-339879

[51] Int. Cl.[6] ..... H01B 1/08; H01B 1/14

[52] U.S. Cl. ..... 252/521; 252/519; 338/308; 338/314; 428/689; 423/21.1; 423/138; 423/594

[58] Field of Search ..... 252/518, 519, 252/521; 338/308, 314; 428/689, 697; 423/21.1, 138, 594

[56] References Cited

U.S. PATENT DOCUMENTS

| | | | |
|---|---|---|---|
| 4,376,725 | 3/1983 | Prabhu et al. | 252/512 |
| 4,536,328 | 8/1985 | Hankey | 252/518 |
| 4,539,223 | 9/1985 | Hormadaly | 427/102 |
| 4,814,107 | 3/1989 | Steinberg | 252/512 |

FOREIGN PATENT DOCUMENTS

| | | |
|---|---|---|
| 62-5508 | 1/1987 | Japan . |
| 4125901 | 3/1989 | Japan . |

OTHER PUBLICATIONS

Hikita et al., "Lanthanum–Cobalt thermistors for temperature measurements", Chemical Abstracts, vol. 85, No. 18, Nov. 1976, p. 875, col. 23.

S.P. Tolochko et al., "Electrical conductivity of complex oxides La/sub 1–x/SrCoO/sub 3/(x=0.2–1.0)", Inorganic Materials, vol. 17, No. 6, May 1981, pp. 749–753.

Labrincha et al. "Evaluation Of Deposition Techniques of Cathode Materials For Solid Oxide Fuel Cells", Mat. Res. Bull. vol. 28, pp. 101–109, 1993.

Timarù et al "Preparation of Perovskite–Type Oxides of Cobalt by the Malic Acid Aided Process . . . " J. Electrochem. Soc., vol. 142, No. 1, Jan. 1995, pp. 148–153.

*Primary Examiner*—Douglas J. McGinty
*Assistant Examiner*—Mark Kopec
*Attorney, Agent, or Firm*—Ostrolenk, Faber, Gerb & Soffen, LLP

[57] ABSTRACT

An organic vehicle is added to and kneaded with a solid component comprising from 60 to 95% by weight of a resistive material having a composition of $La_xSr_{1-x}CoO_3$ (x is from 0.40 to 0.60) and from 5 to 40% by weight of glass frit to obtain a resistive paste. A substrate is coated with the resistive paste and fired to produce a resistor. The resistive paste can be fired in any of air, neutral and reducing atmospheres. The resistor has any desired resistance value within a broad range, and the reproducibility of the resistor with a desired resistance value is good.

6 Claims, 1 Drawing Sheet

RESISTIVE MATERIAL, AND RESISTIVE PASTE AND RESISTOR COMPRISING THE MATERIAL

BACKGROUND OF THE INVENTION

1. Field of the Invention

The present invention relates to a resistive material, a resistive paste which can be fired in an oxidizing, neutral or reducing atmosphere, and a resistor formed by he use of the resistive paste.

2. Description of the Related Art

In general, a ceramic substrate such as alumina, zirconia or the like is provided with circuit patterns for electrodes, resistors, etc., in order that various electronic parts can be mounted thereon. Electrodes (electrode patterns) are generally formed on the substrate by screen-printing a noble metal electrode paste comprising, silver, a silver-palladium alloy or the like as the conductive component, followed by baking the thus-printed paste in air. Resistors (resistor patterns) which are to connect the thus-formed electrode patterns with each other are usually also formed by printing a resistive paste comprising a resistive material of an oxide of a noble metal such as ruthenium at predetermined sites followed by b it in air.

However, a noble metal paste such as that mentioned above is not only expensive but also problematic in its migration resistance. Therefore the tendency for such an expensive noble metal paste to be replaced by a base metal paste comprising, as the conductive component, copper, nickel, aluminum or the like has become accepted in this technical field. Such a base metal paste can be screen-printed on a substrate and then fired in the neutral or reducing atmosphere to give an inexpensive and good electrode pattern.

In this case, it is desirable that the resistive paste which is to form resistors (resistor patterns) on the substrate, by which the plural base electrodes as formed by baking the printed base metal paste are connected with each other, can also be fired in a neutral or reducing atmosphere. Therefore, various resistive pastes that can be fired in a neutral or reducing atmosphere to form resistors (resistor patterns) have been proposed.

Of conventional resistive pastes, those that can be fired in an air atmosphere consist essentially of expensive noble metal oxides such as ruthenium oxide or bismuth-ruthenium composite oxide (pyrochroite type material), while a metal glaze resistive paste comprising silver-palladium is used on rare occasions only when resistors in low-resistance regions are formed.

As materials that can be fired in a neutral or reducing atmosphere, various resistive pastes comprising $LaB_6$, $SnO_2$, silicides, $SrRuO_3$, $Nb_xLa_{1-x}B_{6-4x}$ or the like have been proposed and have already been put to practical use.

However, the above-mentioned conventional resistive pastes may be fired in different atmospheres and, at present, there are known only a few resistive pastes that can be fired in either air or reducing atmospheres. In addition, conventional resistive pastes for thick resistor films are expensive because of comprising noble metal oxides. In the prior art, the resistance values of resistors are controlled (or varied) by changing the ratio of the resistive material to glass frit with which it is mixed. However, depending on the type of the resistive material to be used, the change in the mixing ratio often causes a too rapid change in the resistance values of the resistors formed and is therefore problematic in that it is difficult to attain the desired resistance values and in that the reproducibility in the production of the desired resistors is extremely poor.

SUMMARY OF THE INVENTION

The object of the present invention is to provide a resistive paste which can be fired in any of air, neutral and reducing atmospheres to reliably give resistors having any desired resistance values within a broad range, a resistive material which constitutes the resistive paste, and a resistor which can be formed by the use of the resistive paste and which can realize resistance values within a broad range while the reproducibility of the realizable resistance values is good.

The resistive material which the present invention provides so as to attain the above-mentioned object is characterized in that it has a composition of the general formula:

$$La_xSr1\text{-}xCoO_3$$

wherein x is from about 0.40 to 0.60.

The resistive paste which the present invention also provides so as to attain the above-mentioned object is characterized in that it comprises a solid component consisting of from about 60 to 95% by weight of the resistive material and from about 5 to 40% by weight of glass frit and an organic vehicle.

The resistor which the present invention also provides so as to attain the above-mentioned object is characterized in that it is formed by coating the resistive paste on a substrate and then baking it thereon in an air atmosphere or in a neutral or reducing atmosphere such as in nitrogen.

DETAILED DESCRIPTION OF THE INVENTION

Figure 1:
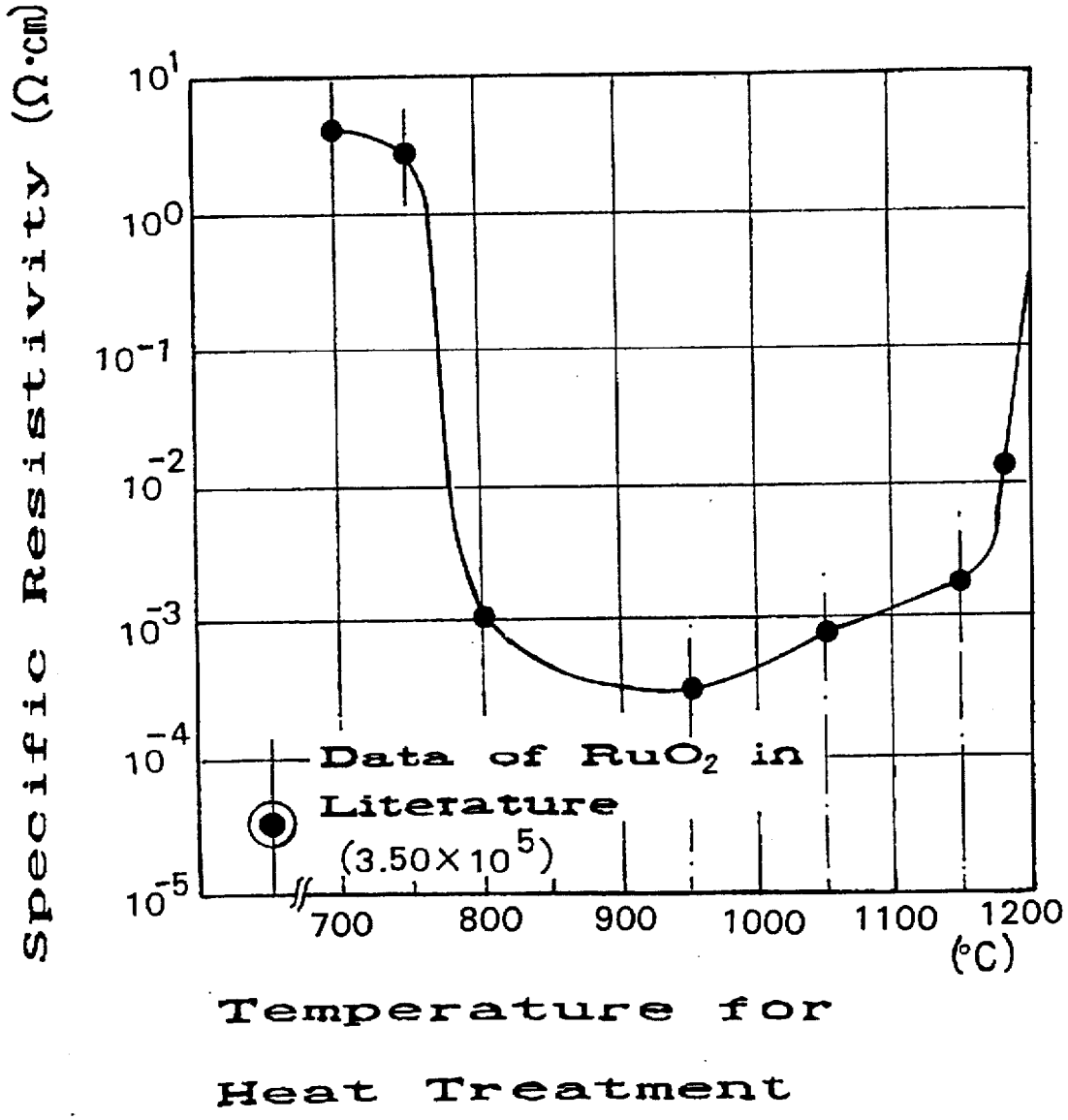
FIG. 1 is a graph showing the relationship between temperatures at which resistive materials were produced in the examples and the comparative examples mentioned hereinunder and the specific resistivity values of the materials.

The resistive material of the present invention has a composition of a general formula:

$$La_xSr_{1-x}CoO_3$$

wherein x is from about 0.40 to 0.60.

One embodiment of the resistive material is such that the material is produced by heating a raw material mixture to be prepared by mixing a La-containing raw material substance, a Sr-containing raw material substance and a Co-containing raw material substance at a predetermined ratio, at a temperature falling between about 800° C. and 1150° C.

The resistive paste of the present invention comprises a solid component consisting of from about 60 to 95%, preferably about 65 to 90%, by weight of the resistive material and from about 5 to 40%, preferably about 10 to 35%, by weight of glass frit and an organic vehicle.

One embodiment of the resistive paste is such that the glass frit is (a) a lead zinc borosilicate glass frit comprising from about 15 to 25 mol % of $B_2O_3$, from about 40 to 50 mol % of $SiO_2$, from about 15 to 25 mol % of PbO and from about 7 to 13 mol % of ZnO, or (b) a calcium barium borosilicate glass frit comprising from about 3 to 10 mol % of $B_2O_3$, from about 35 to 45 mol % of $SiO_2$, from about 25 to 35 mol % of CaO and from about 15 to 20 mol % of BaO.

The resistor of the present invention is formed by coating the resistive paste on a substrate and then baking it thereon in an air atmosphere or in a neutral or reducing atmosphere such as in nitrogen.

In the resistive material of the present invention, x falls between about 0.40 and 0.60. This is because, if x is less than 0.40 or more than 0.60, the resistive material has a much increased specific resistivity value (not lower than $10^{-1}$ Ω·cm) and therefore loses electroconductivity. If so, the material cannot satisfy the object of the present invention where the material is one having electroconductivity in some degree.

In the resistive paste of the present invention, the content of the resistive material in the solid component falls between about 60% by weight and 95% by weight and that of the glass frit in the same falls between about 5% by weight and 40% by weight. This is because if the content of the glass frit is less than 5% by weight, the adhesiveness between a fired resistor and the substrate is lowered with the result that the resistor formed can be peeled from the substrate, but if it is more than 40% by weight, the specific resistivity of the resistor formed is unfavorably too large.

The particle size of the resistive material to be in the resistive paste of the present invention is preferably from about 0.1 to 5 μm, more preferably from about 0.5 to 3 μm.

The particle size of the glass frit to be in the resistive paste of the present invention is preferably from about 1 to 10 μm, more preferably not larger than about 5 μm.

To prepare the resistive paste of the present invention, an organic vehicle is added to and kneaded with a mixture (solid component) comprising the resistive material and glass frit, so that the resulting resistive paste shall have the necessary printability. For this, various organic vehicles which are generally used in ordinary resistive pastes for forming thick film resistors are employable and which are prepared, for example, by dissolving an ethyl cellulose resin or acrylic resin in a terpene solvent such as α-terpineol or in a high-boiling point solvent such as kerosene, butyl carbitol, carbitol acetate or the like. If desired, additives may be added to the paste so as to make it thixotropic.

The present invention is explained in more detail with reference to the following examples, which, however, are not intended to restrict the scope of the present invention.

Examples

Production of Resistive Material Samples

As raw material substances for resistive materials, powdery $La_2O_3$, SrCO3 and $Co_3O_4$ were weighed at predetermined proportions, mixed, put into a crucible and heated in air at predetermined temperatures. The raw material substances used are not be limited to only the abovementioned ones but carbonates may be used in place of the oxides or other oxides may be used in place of carbonates. As the case may be, any other substances (compounds) may also be used.

In these examples, the raw material substances were weighed at such proportions that x in the general formula $La_xSr_{1-x}CoO_3$ representing the resistive material of the present invention is 0.30, 0.40, 0.50, 0.60 or 0.70.

The heat treatment for heating the raw material mixtures to produce resistive materials was conducted in an air atmosphere at 650° C., 750° C., 800° C., 850° C., 950° C., 1050° C., 1150° C. or 1180° C. for 5 hours. The heating speed for the treatment was 5° C./min. As one comparative example, a raw material mixture which was not heated was also prepared. The heat treatment for the other comparative examples was conducted at 950° C.

Each product thus produced was put into a partial stabilized zirconia pot and ground in a pure water medium along with grinding media therein, using a shaking mill, into a powder having a mean particle size of 2 μm or so. The powders were then dried to be resistive materials of the examples of the present invention and comparative examples.

The thus-obtained resistive materials each were formed into green compacts and the relative specific resistivity was measured according to the method mentioned below.

First, each resistive material to be measured was dried, and about 50 mg of the material was weighted and put into a mold, to which a load (50 kgf/cm$^2$) was applied for 10 seconds. A pellet having an outer diameter of about 0.4 cm was formed, and this was taken out of the mold. The shape (with respect to the outer diameter and the height) of the thus-shaped pellet was measured with a micrometer. Next, both surfaces of the pellet were coated with a thermosetting silver electrode composition and then fired. The resistance value and the specific resistivity value of the thus-obtained pellet (green compact) were measured. In addition, the resistance values and the specific resistivity values of green compacts of $RuO_2$ and $CaRuO_3$, of which the specific resistivity values were known (monitors), were also measured under the same condition. On the basis of the values of the monitors, the relative specific resistivity value of each green compact sample pellet was calculated and presumed. The results obtained are shown in Table 1 below. In Table 1, sample No. (1) is the resistive material sample that had not been heat-treated.

TABLE 1

| Sample Number | Molar Ratio (x) | Temperature for Heat Treatment (°C.) | Size of Sample Length (cm) | Size of Sample Outer Diameter (cm) | Resistance Value Measured (Ω) | Specific Resistivity Value Measured (Ω cm) | Relative Specific Resistivity Value Calculated (Ω cm) |
|---|---|---|---|---|---|---|---|
| $RuO_2$ | — | — | 0.906 | 0.403 | 2.48 | 0.349 | $3.50 \times 10^{-5}$ (data in literature) |
| $CaRuO_3$ | — | — | 0.777 | 0.406 | 222 | 37.0 | $3.70 \times 10^{-3}$ |
| *(1) | 0.5 | Not heat-treated | 1.005 | 0.405 | 563K | 72208 | 7.22 |
| *(2) | 0.5 | 650 | 1.052 | 0.404 | 433K | 52775 | 5.28 |
| *(3) | 0.5 | 750 | 1.206 | 0.403 | 267K | 28202 | 2.82 |
| (4) | 0.5 | 800 | 0.635 | 0.405 | 56.1 | 11.3 | $1.13 \times 10^{-4}$ |
| (5) | 0.5 | 850 | 0.575 | 0.405 | 5.71 | 1.28 | $1.28 \times 10^{-4}$ |
| (6) | 0.5 | 950 | 0.754 | 0.407 | 19.4 | 3.34 | $3.35 \times 10^{-4}$ |
| (7) | 0.5 | 1050 | 0.555 | 0.402 | 36.1 | 8.31 | $8.33 \times 10^{-4}$ |
| (8) | 0.5 | 1150 | 1.118 | 0.403 | 171 | 129.5 | $1.95 \times 10^{-3}$ |

TABLE 1-continued

| Sample Number | Molar Ratio (x) | Temperature for Heat Treatment (°C.) | Size of Sample Length (cm) | Outer Diameter (cm) | Resistance Value Measured (Ω) | Specific Resistivity Value Measured (Ω cm) | Relative Specific Resistivity Value Calculated (Ω cm) |
|---|---|---|---|---|---|---|---|
| *(9) | 0.5 | 1180 | 0.810 | 0.405 | 924 | 147 | $1.47 \times 10^{-2}$ |
| *(10) | 0.3 | 950 | 0.634 | 0.404 | 9.02K | 5748 | $5.75 \times 10^{-1}$ |
| *(11) | 0.7 | 950 | 0.703 | 0.405 | 3.78K | 2177 | $2.18 \times 10^{-1}$ |

In Table 1 above, the samples with asterisk (*) are comparative samples not falling within the scope of the present invention.

The "specific resistivity value measured" in Table 1 is the actually measured specific resistivity value (ρ) of the green compact sample, which is obtained according to the following equation.

$$\rho=(R\times A)/L$$

wherein R is the actually measured resistance value (Ω),

A is the cross sectional area ($cm^2$), and

L is the length (cm).

The "relative specific resistivity value calculated" in Table 1 is value calculated from the actually measured specific resistivity values of the individual samples, on the presumption that the ratio of the data ($3.50\times10^{-5}$ Ω·cm) of the monitor sample $RuO_2$ in literature to the actual measured specific resistivity value (0.349 Ω·cm) thereof applied to the other samples. The reasonability of the relative specific resistivity value thus calculated is established by the fact that the data of $CaRuO_3$ in literature is $3.7\times10^{-3}$ Ω·cm and is the same as the data in Table 1 which was calculated from the actual measured specific resistivity value thereof. Accordingly, it is understood that the method employed herein is reasonable for determining the relative specific resistivity value of each sample.

The relationship between the temperature at which each sample was heat-treated and the specific resistivity value of each sample is shown in FIG. 1. From the data in Table 1 and FIG. 1, it is known that the composite oxides of $La_xSr_{1-x}CoO_3$ as produced by heat treatment at temperatures falling between 800° C. and 1150° C. can have a controlled relative specific resistivity value on a level of $10^{-4}$ Ω·cm (partly on a level of $10^{-3}$ Ω·cm).

From the data in Table 1 and FIG. 1, it is also known that when the temperature for the heat treatment for producing the composite oxides is lower than 800° C. or higher than 1150° C., the composite oxides produced have an extremely high specific resistivity value and are therefore unsuitable for practical use.

Though not shown in Table 1 and FIG. 1, it has been confirmed that resistive materials with a desired specific resistivity value (electroconductivity) are also obtained when mixtures comprising raw material substances at a molar ratio (x) of Sr to La of being from 0.40 to 0.60 are heat-treated at temperatures falling between 800° C. and 1150° C., like those having a molar ratio (x) of 0.50 as above.

If, however, the molar ratio (x) of Sr to La is not between 0.40 and 0.60, for example, as in sample No. (10) (where x=0.30) or in sample No. (11) (where x=0.70), the relative specific resistivity values calculated of the products are on a level of 10–1 Ω·cm or, that is, the products have an extremely large specific resistivity value and therefore lose electroconductivity. These could not be used as resistive materials and are unfavorable for the object of the present invention.

Formation of Glass Frit Samples

Apart from the resistive material samples prepared above, a lead zinc borosilicate glass frit sample (hereinafter referred to as "glass frit A") and a calcium barium borosilicate glass frit sample (hereinafter referred to as "glass frit B") were prepared according to the methods mentioned below.

First, raw materials for glass frit A, $B_2O_3$, $SiO_2$, PbO and ZnO were mixed at a molar ratio of 21.5:46.2:21.5:11.8 and then melted at from 1200° to 1350° C. to obtain a fused glass of $B_2O_3$-$SiO_2$-PbO-ZnO. This fused glass was rapidly cooled by putting it into pure water and then ground, using a sh mill, into particles having a mean particle size of not larger than 5 μm. Thus was obtained a glass frit sample (glass frit A). As the raw materials for glass frit A, also employable are carbonates, etc., in place of the above-mentioned oxides.

On the other hand, raw materials for glass frit B, $B_2O_3$, $SiO_2$, BaO and CaO were mixed at a molar ratio of 8.6:41.0:18.0:32.4 and then melted at from 1200° to 1350° C. to obtain a fused glass of $B_2O_3$-$SiO_2$-BaO-CaO. This fused glass was rapidly cooled by putting it into pure water and then ground, using a shaking mill, into particles having a mean particle size of not larger than 5 μm. Thus was obtained a glass frit sample (glass frit B). As the raw materials for glass frit B, also employable are carbonates, etc., in place of the above-mentioned oxides.

Formation of Resistive Paste Samples

The resistive material sample produced at 1050° C. and glass frit A were mixed at various ratios shown in Table 2 below, while the resistive material sample produced at 950° C. and glass frit B were mixed at various ratios shown in Table 3 below.

TABLE 2

| Sample Number | Molar Ratio (x) | Resistive Material (wt. %) | Glass Frit A (wt.%) | Atmosphere for Heating | Electrode Material | Sheet Resistance Value (Ω) |
|---|---|---|---|---|---|---|
| *1 | 0.30 | 95 | 5 | Air | Ag—Pd | 1 G or more |
| 2 | 0.40 | 95 | 5 | Air | Ag—Pd | 65K |
| 3 | 0.40 | 60 | 40 | Air | Ag—Pd | 3.63M |
| *4 | 0.50 | 100 | 0 | Air | Ag—Pd | Peeled |

TABLE 2-continued

| Sample Number | Molar Ratio (x) | Resistive Material (wt. %) | Glass Frit A (wt.%) | Atmosphere for Heating | Electrode Material | Sheet Resistance Value (Ω) |
|---|---|---|---|---|---|---|
| 5 | 0.50 | 95 | 5 | Air | Ag—Pd | 1.44K |
| 6 | 0.50 | 80 | 20 | Air | Ag—Pd | 135K |
| 7 | 0.50 | 60 | 40 | Air | Ag—Pd | 1.26M |
| *8 | 0.50 | 55 | 45 | Air | Ag—Pd | 1 G or more |
| 9 | 0.60 | 95 | 5 | Air | Ag—Pd | 38K |
| 10 | 0.60 | 60 | 40 | Air | Ag—Pd | 12.6M |
| *11 | 0.70 | 95 | 5 | Air | Ag—Pd | 1 G or more |
| *12 | 0.30 | 95 | 5 | Nitrogen | Cu | 1 G or more |
| 13 | 0.40 | 95 | 5 | Nitrogen | Cu | 456K |
| 14 | 0.40 | 60 | 40 | Nitrogen | Cu | 35.3M |
| *15 | 0.50 | 100 | 0 | Nitrogen | Cu | Peeled |
| 16 | 0.50 | 95 | 5 | Nitrogen | Cu | 14.3K |
| 17 | 0.50 | 80 | 20 | Nitrogen | Cu | 936K |
| 18 | 0.50 | 60 | 40 | Nitrogen | Cu | 10.3M |
| *19 | 0.50 | 55 | 45 | Nitrogen | Cu | 1 G or more |
| 20 | 0.60 | 95 | 5 | Nitrogen | Cu | 583K |
| 21 | 0.60 | 60 | 40 | Nitrogen | Cu | 159M |
| *22 | 0.70 | 95 | 5 | Nitrogen | Cu | 1 G or more |

TABLE 3

| Sample Number | Molar Ratio (x) | Resistive Material (wt. %) | Glass Frit B (wt.%) | Atmosphere for Heating | Electrode Material | Sheet Resistance Value (Ω) |
|---|---|---|---|---|---|---|
| *23 | 0.30 | 95 | 5 | Air | Ag—Pd | 1 G or more |
| 24 | 0.40 | 95 | 5 | Air | Ag—Pd | 56K |
| 25 | 0.40 | 60 | 40 | Air | Ag—Pd | 3.35M |
| *26 | 0.50 | 100 | 0 | Air | Ag—Pd | Peeled |
| 27 | 0.50 | 95 | 5 | Air | Ag—Pd | 1.09K |
| 28 | 0.50 | 80 | 20 | Air | Ag—Pd | 235K |
| 29 | 0.50 | 60 | 40 | Air | Ag—Pd | 1.03M |
| *30 | 0.50 | 55 | 45 | Air | Ag—Pd | 1 G or more |
| 31 | 0.60 | 95 | 5 | Air | Ag—Pd | 26K |
| 32 | 0.60 | 60 | 40 | Air | Ag—Pd | 10.5M |
| *33 | 0.70 | 95 | 5 | Air | Ag—Pd | 1 G or more |
| *34 | 0.30 | 95 | 5 | Nitrogen | Cu | 1 G or more |
| 35 | 0.40 | 95 | 5 | Nitrogen | Cu | 390K |
| 36 | 0.40 | 60 | 40 | Nitrogen | Cu | 13.7M |
| *37 | 0.50 | 100 | 0 | Nitrogen | Cu | Peeled |
| 38 | 0.50 | 95 | 5 | Nitrogen | Cu | 8.72K |
| 39 | 0.50 | 80 | 20 | Nitrogen | Cu | 665K |
| 40 | 0.50 | 60 | 40 | Nitrogen | Cu | 7.86M |
| *41 | 0.50 | 55 | 45 | Nitrogen | Cu | 1 G or more |
| 42 | 0.60 | 95 | 5 | Nitrogen | Cu | 439K |
| 43 | 0.60 | 60 | 40 | Nitrogen | Cu | 263M |
| *44 | 0.70 | 95 | 5 | Nitrogen | Cu | 1 G or more |

In Tables 2 and 3, the samples with asterisk (*) are comparative examples where the molar ratio (x) of Sr to La is outside the scope of the present invention or the proportion of the glass frit to the resistive material is outside the scope of the present invention.

To the mixture (solid component) comprising the resistive material and the glass frit was added an organic vehicle as prepared by dissolving an acrylic resin in α-terpineol. The resulting blend was kneaded, using a mixer such as a three-roll kneader or the like, to obtain a resistive paste.

The proportion of the solid component (mixture comprising resistive material and glass frit) to the organic vehicle was about 70:30 by weight.

Formation of Resistor Samples

First, a silver-palladium paste or a copper paste was screen-printed on an insulating substrate of alumina and fired in an air atmosphere or nitrogen atmosphere to form electrodes thereon.

Next, the resistive paste sample obtained in the manner as above was screen-printed between the electrodes as formed on the alumina substrate to form a pattern thereon, which partly covered both terminal electrodes and had a length of 1.5 mm, a width of 1.5 mm and a dry thickness of 20 μm. Then, this was leveled and thereafter dried at 150° C. for 10 minutes. Next, the alumina substrate having the silver-palladium electrodes thereon was fired in a tunnel furnace having an air atmosphere at a peak temperature of 850° C. for 10 minutes, whereby a resistor was formed on the substrate. On the other hand, the alumina substrate having copper electrodes thereon was fired in a tunnel furnace having a nitrogen atmosphere at a peak temperature of 900° C. for 10 minutes, whereby a resistor was formed on the substrate. Thus, resistor samples were prepared.

Evaluation of Characteristics

The sheet resistance value of each resistor sample prepared as above was measured. Table 2 above shows the data measured with the resistor samples that had been prepared by use of the resistive pastes comprising glass frit A, while Table 3 above shows those of the resistor samples that had been prepared by use of the resistive pastes comprising glass frit B. The sheet resistance value was measured at 25° C., using digital volt meter.

As shown in Table 2 and Table 3 above, the resistor samples that had been prepared by the use of the resistive pastes comprising the resistive material prepared in the above have somewhat different resistance values, depending on the type of the glass frit in the resistive paste used. With respect to the molar ratio (x) of Sr to La, the resistor samples produced in air (for silver-palladium electrodes) or nitrogen (for copper electrodes) all had a sheet resistance value falling within the practicable range when the molar ratio (x) falls within the range of the present invention of from 0.40 to 0.60. On the other hand, however, if the molar ratio (x) was less than 0.40 or more than 0.60, the specific resistivity value of the resistors was too large or was not lower than 1 GΩ so that the resistors could not be put to practical use (see sample Nos. 1, 11, 12, 22 in Table 2 and sample Nos. 23, 33, 34, 44 in Table 3).

Regarding the mixing ratio of the glass frit to the resistive material, the resistor samples having a content of the resistive material falling between 60% by weight and 95% by weight (therefore having a content of the glass frit falling between 5% by weight and 40% by weight) that had been produced in air (for silver-palladium electrodes) or nitrogen (for copper electrodes) all had a resistance value falling within a practicable range. On the other hand, however, if the mixing ratio of the glass frit to the resistive material oversteps the above-mentioned range of the present invention, the resistor films formed peeled (see sample Nos. 4, 15 in Table 2, sample Nos. 26, 37 in Table 3) or had too large a specific resistivity value of not lower than 1 GΩ (see sample Nos. 8, 19 in Table 2, sample Nos. 30, 41 in Table 3) so that the resistors could not be put to practical use.

In the above-mentioned examples, used were a lead zinc borosilicate glass frit comprising $B_2O_3$, $SiO_2$, PbO and ZnO at a molar ratio of 21.5:46.2:21.5:11.8 or a calcium barium borosilicate glass frit comprising $B_2O_3$, $SiO_2$, BaO and CaO at a molar ratio of 8.6:41.0:18.0:32.4. However, the components constituting the glass frit for use in the present invention and the composition ratios of the components are not limited to those illustrated in these examples. Needless-to-say, it is possible in the present invention to employ other glass frits comprising other components than the illustrated ones and glass frits having other composition ratios other than the illustrated ones.

The above-mentioned examples have demonstrated the formation of the resistors on an alumina substrate. However, the substrate on which the resistors of the present invention are formed is not limited to such alumina substrates but the present invention is applicable to the formation of the resistors on other various substrates or bases made of other various materials.

The present invention is not limited to only the above-mentioned examples with respect to the other various aspects. For example, the proportion of the organic vehicle to the solid component comprising a resistive material and glass frit in the resistive paste of the present invention and the temperature conditions and the atmosphere conditions for baking the resistive paste can be variously changed or modified within the scope and the spirit of the present invention.

As has been described in detail hereinabove, the resistive paste of the present invention is formed by adding an organic vehicle to a solid component comprising from 60 to 95% by weight of the resistive material of the present invention which has a composition of a general formula $La_xSr_{1-x}CoO_3$ (where x is from 0.40 to 0.60) and from 5 to 40% by weight of a glass frit, followed by kneading them, and this can be fired in any of air, neutral and reducing atmospheres. By coating a substrate with the resistive paste of the present invention and firing it, it is possible to reliably produce a resistor which is lower priced than any conventional resistor. In addition, the increase in the resistance value of the resistor thus produced of the present invention is gentle, and the reproducibility of the resistor of the present invention with such gentle increase in the resistance value is good.

Specifically, according to the present invention, it is possible to obtain a resistive material having a composition of $La_xSr_{1-x}CoO_3$ (where x is from 0.40 to 0.60) and having a variable specific resistivity value on a level of $10^{-4}$ Ω·cm by suitably selecting the value x within the defined range and by suitably varying the temperature at which the components constituting the material are heat-treated within a range between 800° C. and 1150° C. In addition, it is also possible to reliably produce a resistor having a resistance value variable within a broad range by employing the resistive paste of the present invention which comprises the resistive material and a glass frit at a suitably variable ratio.

While the invention has been described in detail and with reference to specific embodiments thereof, it will be apparent to one skilled in the art that various changes and modifications can be made therein without departing from the spirit and scope thereof.

What is claimed is:

1. An electrically resistive paste comprising an organic vehicle and a solid component comprising from about 60 to 95% by weight of an electrically resistive material having a composition of the formula:

$$La_xSr_{1-x}CoO_3$$

wherein x is from about 0.40 to 0.60 and from about 5 to 40% by weight of glass frit selected from the group consisting of (a) a lead zinc borosilicate glass frit comprising from about 15 to 25 mol % of $B_2O_3$, from about 40 to 50 mol % of $SiO_2$, from about 15 to 25 mol % of PbO and from about 7 to 13 mol % of ZnO, and (b) a calcium barium borosilicate glass frit comprising from about 3 to 10 mol % of $B_2O_3$, from about 35 to 45 mol % of $SiO_2$, from about 25 to 35 mol % of CaO and from about 15 to 20 mol % of BaO.

2. The resistive paste as claimed in claim 1, wherein said electrically resistive material was produced by heating a material mixture of La, Sr and Co containing raw material substances at a temperature between about 800° C. and 1150° C.

3. An electrical resistor comprising a substrate having a resistive paste of claim 1 fired thereon.

4. An electrical resistor comprising a substrate having a resistive paste of claim 2 fired thereon.

5. A method of producing an electrically resistive paste having a predetermined resistivity value which comprises heating a material mixture of La, Sr and Co containing raw material substances at a temperature between about 800° C. and 1150° C. wherein said mixture of raw materials are present in such an amount that an electrically resistive material having a composition of the formula:

$La_xSr_{1-x}CoO_3$ wherein x is from about 0.40 to 0.60 is formed upon heating and combining said material with a glass frit selected from the group consisting of (a) a lead zinc borosilicate glass frit comprising from about 15 to 25 mol % of $B_2O_3$, from about 40 to 50 mol % of $SiO_2$, from about 15 to 25 mol % of PbO and from about 7 to 13 mol % of ZnO, and (b) a calcium barium borosilicate glass frit comprising from about 3 to 10 mol % of $B_2O_3$, from about 35 to 45 mol % of $SiO_2$, from about 25 to 35 mol % of CaO and from about 15 to 20 mol % of BaO.

6. The method of claim 5, wherein about 60 to 95 parts by weight of said electrically resistive material is combined with about 5 to 40 parts by weight of said glass frit.

* * * * *